United States Patent [19]

Elam

[11] Patent Number: 4,834,687

[45] Date of Patent: May 30, 1989

[54] LOG SPLITTING TOY

[76] Inventor: Ronald J. Elam, P.O. Box 441, Oakland, Ill. 61943

[21] Appl. No.: 70,422

[22] Filed: Jul. 7, 1987

[51] Int. Cl.[4] ..... A63H 33/00

[52] U.S. Cl. ..... 446/4; 446/1; 446/901; 273/DIG. 30

[58] Field of Search ..... 446/1, 4, 5, 144, 901; 273/DIG. 30

[56] References Cited

U.S. PATENT DOCUMENTS

| | | | |
|---|---|---|---|
| 1,555,993 | 10/1925 | Larson | 446/1 |
| 2,197,976 | 4/1940 | Fletcher | 35/29 |
| 2,837,862 | 6/1958 | Cleveland | 46/1 |
| 2,955,381 | 10/1960 | Joslyn | 46/19 |
| 3,390,483 | 7/1968 | Doe | 46/177 |
| 3,917,271 | 11/1975 | Lemelson et al. | 273/DIG. 30 X |
| 4,225,137 | 9/1980 | Hebner | 273/DIG. 30 X |
| 4,398,715 | 8/1983 | Hall | 273/DIG. 30 X |
| 4,755,141 | 7/1988 | Nakai | 446/901 X |

FOREIGN PATENT DOCUMENTS

| | | | |
|---|---|---|---|
| 865290 | 6/1962 | France | 446/901 |
| 1257666 | 12/1971 | United Kingdom | 446/901 |
| 2082925 | 3/1982 | United Kingdom | 446/901 |

*Primary Examiner*—Mickey Yu
*Assistant Examiner*—D. Neal Muir
*Attorney, Agent, or Firm*—Richard C. Litman

[57] ABSTRACT

A toy which, when employed, simulates log splitting, comprises two log halves that cosmetically portray natural log halves, each half having a fastener for joining the halves together and a cavity that creates a slot when the halves are joined. A wedge is applied to the slot to split the log by separating the fasteners with the aid of a sledge.

2 Claims, 1 Drawing Sheet

LOG SPLITTING TOY

BACKGROUND TO THE INVENTION

Field of Invention

This invention relates to a toy and more particularly, to an improved toy serving to provide both amusement and training in eye-hand coordination.

The invention involves a toy, the manipulation of which simulates the splitting of a log. During operation of the device a child's physical abilities are enhanced through actions very similar to those utilized by a person actually splitting a log. The method of construction of the device is more fully described herein.

SUMMARY OF THE INVENTION

An object of the invention is to provide a novel toy that is simple, interest-holding and realistic in use and provides a child with the experience of splitting a log.

Another object of the invention is to provide a toy, teaching a prescribed manner for the assembly and disassembly of its parts.

A further object of the invention is to provide a toy exhibiting a strikingly realistic sequence of operations.

Another object of the invention is directed to a toy which, when employed, gives evidence of a child's basic behavior pattern, whether constructive or destructive.

These, together with other objects and advantages of the invention, reside in the details of the process and the operation thereof, as is more fully hereinafter described and claimed. Reference is made to the drawing forming a part hereof, wherein like numerals refer to like parts throughout.

DESCRIPTION OF THE PRIOR ART

Various prior art knock apart toys and the like, as well as their apparatus and the method of their construction in general, are known and found to be exemplary of the prior art are:

| U.S. Pat. No. | Inventor |
|---|---|
| 1,555,993 | H. W. Larson |
| 2,197,976 | W. J. Fletcher |
| 2,457,653 | G. E. Froelich |
| 2,837,862 | G. B. Cleveland |
| 2,955,381 | J. Joslyn |
| 3,390,483 | W. P. Doe |

U.S. Pat. No. 2,955,381 to Joslyn discloses a simulated log splitting apparatus. The device comprises a horizontally disposed log that includes a stand and wooden pegs, which the present invention does not include.

U.S. Pat. No. 1,555,993 to Larson discloses a nail driving toy. It has a spring-loaded nail and a hammer used to simulate nail driving.

The remainder of the patents illustrate other pounding or knock apart toys; but none of the above, whether taken singly or in combination, discloses the specific details of the combination of the invention in such a way as to bear upon the claims of the present invention.

DESCRIPTION OF THE PREFERRED EMBODIMENT

Figure 1:
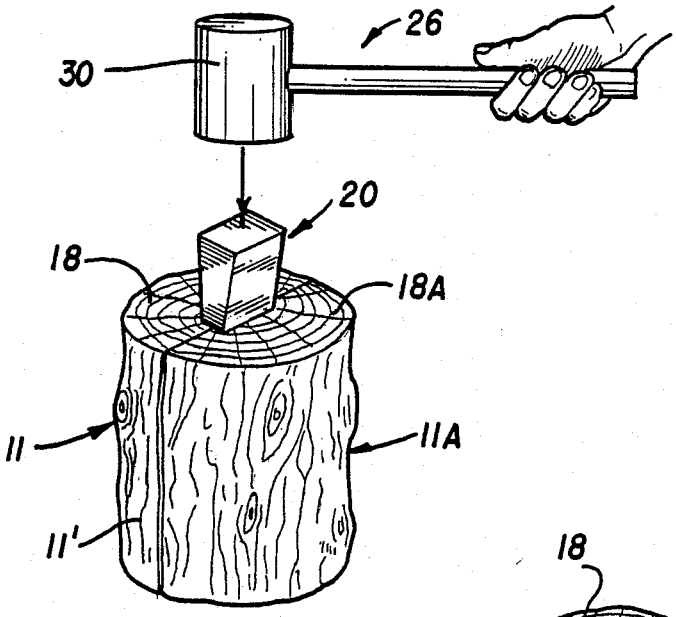
FIG. 1 is a perspective view of the invention.
Figure 4:
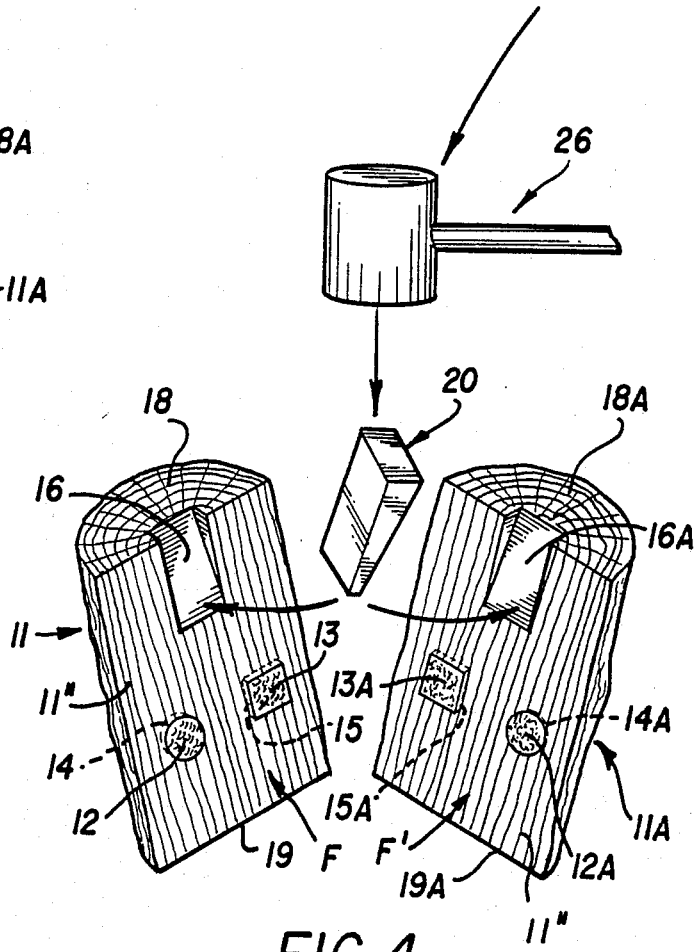
FIG. 4 is an exploded view of the invention in use.

Referring now to the drawings, there is shown in FIGS. 1 and 4 a perspective view and an exploded view, respectively, of two semi-circular log halves 11 and 11A cosmetically simulating a natural log and each having an external brown, bark-like texture 11'. The opposed, planar inner faces F—F' of the two halves are in turn provided with a wood grain texture/color 11'' representative of annual growth rings. The log half 11 includes laterally spaced circular and square fastening elements 12 and 13 on the face F, each comprising a plurality of hooks, while the opposite log half 11A includes circular and square fastening elements 12A and 13A comprising a plurality of loops. Such hook and loop devices may comprise pieces of VELCRO or any other mating components permitting co-joining and separation of the log halves solely by pressure. The fastening elements 12, 12A, 13 and 13A preferably are secured within recessed areas 14, 14A, 15 and 15A to provide a means for fastening the two log halves 11 and 11A together so that when thusly fastened the faces F—F' are juxtaposed. Tapered rectangular cavities 16 and 16A protrude downward from the center of the upper end surfaces 18 and 18A and when opposed as in FIG. 1, provide a tapered opening or slot for a wedge 20 adapted to be inserted therein when the log halves 11 and 11A are fastened into the position representing a whole, or unsplit log.

Figure 2:
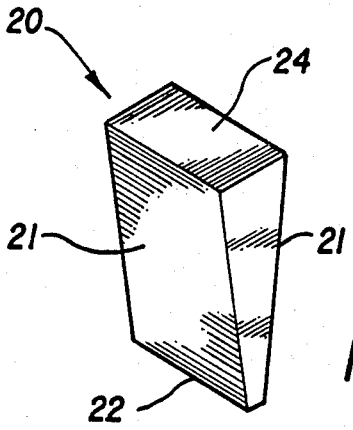
FIG. 2 is a perspective view of the wedge.

FIG. 2 shows the wedge 20, which provides the separating means for the log halves 11 and 11A and includes a tapered lower edge 22 that is inserted into the slot created by the opposed cavities 16 and 16A when log halves 11 and 11A are fastened. The wedge includes a top wall 24 which provides a surface for the wedge to be struck. The wedge may be constructed of any suitable material such as plastics.

Figure 3:
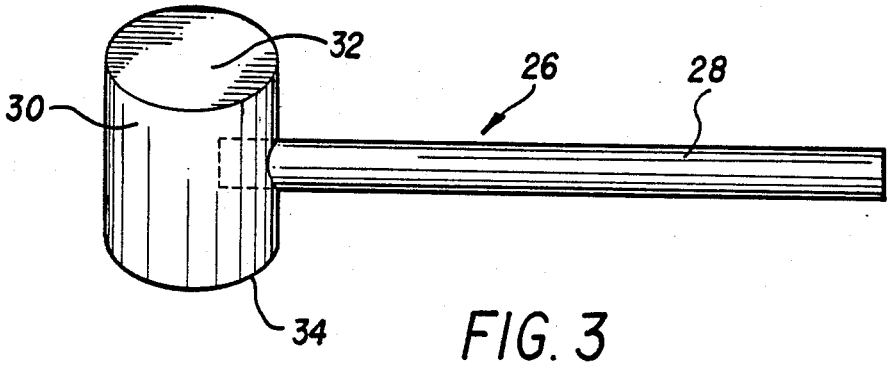
FIG. 3 is a perspective view of the sledge.

FIG. 3 illustrates the top and front views of a sledge 26 providing a striking means and may likewise be constructed of plastics. The sledge includes a cylindrical handle 28 joined to a cylindrical head 30 with bottom and top surfaces 32, 34 for striking the wedge 20.

In the view of FIG. 4 the two log halves 11 and 11A have been separated after sufficient force has been applied to the wedge 20 by a downward force from the sledge 26 or other pounding device. This force causes the wedge 20 to slide downwardly into the cavities 16 and 16A, thereby forcing each log half 11 and 11A to separate by camming apart the faces F—F' against the normal retention action of the fastening means 12, 12A, 13, 13A.

The operation of the toy is assured by constructing the thickness of the wedge 20 so that when fully inserted into the tapered slot formed by the opposed recessee 16–16A, a significant portion of the wedge reposes above the plane of the top or end walls 18–18A, as shown in FIG. 1. In this manner, as soon as the wedge is struck and displaced downwardly, it will be understood that the opposite, inclined faces 21—21 of the wedge will immediately initiate separation of the two halves 11–11A. This splitting will occur in a realistic fashion, that is, progressively from the top downwardly to the planar bottoms 19,19A of the log halves.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, which may be resorted to, fall within the scope of the invention.

What is claimed is:

1. A toy simulating log-splitting comprising, in combination:

a pair of semi-cylindrical members each simulating one-half of a log split longitudinally and having an exterior peripheral surface including simulated bark;

each of said members including semicircular opposite end surfaces and a substantially planar inner face;

said inner faces being adapted for aligned, abutting engagement along a plane of juncture to form a log-simulating assembly;

separate pairs of mating fastening means on said inner faces for releasable engagement along a portion said plane of juncture to retain said members in said log-simulating assembly;

said inner faces each having a tapered cavity arranged in opposed relationship and opening into one of said end surfaces to form a wedge-shaped slot communicating with said end surfaces in said log-simulating assembly; and a tapered wedge member for initial partial insertion in said slot whereby a subsequent downward force on said wedge member produces a progressive and then total separation of said fastening means and said members along said plane of juncture, from said end surfaces having said tapered cavities to the other said end surfaces of said members.

2. A toy as claimed in claim 1 wherein, said fastening means comprises hook and loop fastening means.

* * * * *